US007412379B2

(12) United States Patent
Taori et al.

(10) Patent No.: US 7,412,379 B2
(45) Date of Patent: Aug. 12, 2008

(54) TIME-SCALE MODIFICATION OF SIGNALS

(75) Inventors: Rakesh Taori, Eindhoven (NL); Andreas Johannes Gerrits, Eindhoven (NL); Dzevdet Burazerovic, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 815 days.

(21) Appl. No.: 10/114,505

(22) Filed: Apr. 2, 2002

(65) Prior Publication Data

US 2003/0033140 A1 Feb. 13, 2003

(30) Foreign Application Priority Data

Apr. 5, 2001 (EP) ..... 01201260

(51) Int. Cl.
*G10L 11/06* (2006.01)

(52) U.S. Cl. ..... 704/214; 704/210; 704/215; 704/208

(58) Field of Classification Search ..... 704/214, 704/503–504, 211, 215, 226, 208, 220, 210, 704/207, 219

See application file for complete search history.

(56) References Cited

U.S. PATENT DOCUMENTS

| | | | | |
|---|---|---|---|---|
| 5,809,454 | A * | 9/1998 | Okada et al. | 704/214 |
| 5,828,994 | A * | 10/1998 | Covell et al. | 704/211 |
| 6,070,135 | A * | 5/2000 | Kim et al. | 704/215 |
| 6,484,137 | B1 * | 11/2002 | Taniguchi et al. | 704/211 |
| 6,718,309 | B1 * | 4/2004 | Selly | 704/503 |

FOREIGN PATENT DOCUMENTS

EP 0817168 A1 1/1997

OTHER PUBLICATIONS

D. J. Jones, S.D. Watson, K.G. Evans, B.M.G. Cheetham, and R.A. Reeves, "A Network Speech Echo Canceller with Comfort Noise" ESCA. Eurospeech97, Rhodes, Greece. ISSN 1018-4074, pp. 2607-2610.*

* cited by examiner

*Primary Examiner*—Huyen X. Vo

(57) ABSTRACT

Techniques utilising Time Scale Modification (TSM) of signals are described. The signal is analysed and divided into frames of similar signal types. Techniques specific to the signal type are then applied to the frames thereby optimising the modification process. The method of the present invention enables TSM of different audio signal parts to be realized using different methods, and a system for effecting said method is also described.

16 Claims, 10 Drawing Sheets

TIME-SCALE MODIFICATION OF SIGNALS

FIELD OF THE INVENTION

The invention relates to the time-scale modification (TSM) of a signal, in particular a speech signal, and more particularly to a system and method that employs different techniques for the time-scale modification of voiced and un-voiced speech.

BACKGROUND OF THE INVENTION

Time-scale modification (TSM) of a signal refers to compression or expansion of the time scale of that signal. Within speech signals, the TSM of the speech signal expands or compresses the time scale of the speech, while preserving the identity of the speaker (pitch, format structure). As such, it is typically explored for purposes where alteration of the pronunciation speed is desired. Such applications of TSM include test-to-speech synthesis, foreign language learning and film/soundtrack post synchronisation.

Many techniques for fulfilling the need for high quality TSM of speech signals are known and examples of such techniques are described in E. Moulines, J. Laroche, "Non parametric techniques for pitch scale and time scale modification of speech". In Speech Communication (Netherlands) Vol 16, No. 2 p175-205 1995.

Another potential application of TSM techniques is speech coding which, however, is much less reported. Within this application, the basic intention is to compress the time scale of a speech signal prior to coding, reducing the number of speech samples that need to be encoded, and to expand it by a reciprocal factor after decoding, to reinstate the original timescale. This concept is illustrated in FIG. 1. Since the time-scale compressed speech remains a valid speech signal, it can be processed by an arbitrary speech coder. For example, speech coding at 6 kbit/s could now be realised with a 8 kbit/s coder, preceeded by 25% time-scale compression and succeeded by 33% time-scale expansion.

The use of TSM in this context has been explored in the past, and fairly good results were claimed using several TSM methods and speech coders [1]-[3]. Recently, improvements have been made both to TSM and speech coding techniques, where these two have mostly been studied independently from each other.

As detailed in Moulines and Laroche, as referenced above, one widely used TSM algorithm is synchronised overlap-add (SOLA), which is an example of a waveform approach algorithm. Since its introduction [4], SOLA has evolved into a widely used algorithm for TSM of speech. Being a correlation method, it is also applicable to speech produced by multiple speakers or corrupted by background noise, and to some extent to music.

With SOLA, an input speech signal s is analysed as a sequence of N-samples long overlapping frames $x_i$ (i=0, . . . , m), consecutively delayed by a fixed analysis period of $S_a$, samples ($S_a$<N) The starting idea is that s can be compressed or expanded by outputting these frames while now successively shifting them by a synthesis period $S_s$, which is chosen such that $S_s<S_a$, respectively $S_s>S_a$ ($S_s$<N). The overlapping segments would be first weighted by two amplitude complementary functions then added up, which is a suitable way of waveform averaging. FIG. 2 illustrates such an overlap-add expansion technique. The upper part shows the location of the consecutive frames in the input signal. The middle part demonstrates how these frames would be re-positioned during the synthesis, employing in this case two halves of a Hanning window for the weighting. Finally, the resulting time-scale expanded signal is shown in the lower part.

The actual synchronisation mechanism of SOLA consists of additionally shifting each $x_i$ during the synthesis, to yield similarity of the overlapping waveforms. Explicitly, a frame $x_i$ will now start contributing to the output signal at position $iS_s+k_i$, where $k_i$ is found such that the normalised cross-correlation given by Equation 1 is maximal for k=ki.

$$R_i[k] = \frac{\sum_{j=0}^{L-1} \tilde{s}[iS_s + k + j] \cdot s[iS_a + j]}{\left(\sum_{j=0}^{L-1} s^2[iS_a + j] \cdot \sum_{j=0}^{L-1} \tilde{s}^2[iS_s + k + j]\right)^{1/2}} \quad (0 \le k \le N/2) \qquad \text{(Equation 1)}$$

In this equation, $\tilde{s}$ denotes the output signal while L denotes the length of the overlap corresponding to a particular lag k in the given range [1]. Having found $k_i$, the synchronisation parameters, the overlapping signals are averaged as before. With a large number of frames the ratio of the output and input signal length will approach the value $S_s/S_a$, hence defining the scale factor $\alpha$.

When SOLA compression is cascaded with the reciprocal SOLA expansion, several artefacts are typically introduced into the output speech, such as reverberation, artificial tonality and occasional degradation of transients.

The reverberation is associated with voiced speech, and can be attributed to waveform averaging. Both compression and the succeeding expansion average similar segments. However, similarity is measured locally, implying that the expansion does not necessarily insert additional waveform in the region where it was "missing". This results in waveform smoothing, possibly even introducing new local periodicity. Furthermore, frame positioning during expansion is designed to re-use same segments, in order to create additional waveform. This introduces correlation in unvoiced speech, which is often perceived as an artificial "tonality".

Artefacts also occur in speech transients, i.e. regions of voicing transition, which usually exhibit an abrupt alteration of the signal energy level. As the scale factor increases, so does the distance between '$iS_a$' and '$iS_s$' which may impede alignment of similar parts of a transient for averaging. Hence, overlapping distinct parts of a transient causes its "smearing", endangering proper perception of its strength and timing.

In [5], [6], it was reported that a companded speech signal of a good quality can be achieved by employing the $k_i$'s that are obtained during SOLA compression. So, quite opposite to what is done by SOLA, the N-samples long frames $\hat{x}_i$ would now be excised from the compressed signal $\tilde{s}$ at time instants $iS_s+k_i$ and re-positioned at the original time instants $iS_a$ (while averaging the overlapping samples similar as before). The maximal cost of transmitting/storing all $k_i$'s is given by Equation 2, where $T_s$, is the speech sampling period and $\lceil\ \rceil$ represents the operation of rounding towards the nearest-higher integer.

$$BR_k = \left(\frac{1}{S_a \cdot T_s}\frac{\text{frames}}{\text{sec}}\right) \cdot \left(\left\lceil \log_2\left(\frac{N}{2}\right)\right\rceil \frac{\text{bits}}{\text{frame}}\right) \qquad \text{(Equation 2)}$$

It has also been reported that exclusion of transients from high (i.e. >30%) SOLA compression or expansion yields improved speech quality. [7]

It will be appreciated therefore that presently several techniques and approaches exist that can successfully (e.g. giving good quality) be employed for compressing or expanding the time-scale of signals. Although described specifically with reference to speech signals, it will be appreciated that this description is of an exemplary embodiment of a signal type and the problems associated with speech signals are also applicable to other signal types. When used for coding purposes, where the time-scale compression is followed by time-scale expansion (time-scale companding), the performance of prior art techniques degrade considerably. The best performance for speech signals is generally obtained from time-domain methods, among which SOLA is widely used, but problems still exist using these methods, some of which have been identified above. There is, therefore, a need to provide an improved method and system for time scale modifying a signal in a manner specific to the components making up that signal.

SUMMARY OF THE INVENTION

By providing a method that analyses individual frame segments within a signal and applies different algorithms to specific signal types it is possible to optimise the modification of the signal. Such application of specific modification algorithms to specific signal types enables a modification of the signal in a manner which is adapted to cater for different requirements of the individual component segments that make up the signal.

In a preferred embodiment of the present invention, the method is applied to speech signals and the signal is analysed for voiced and un-voiced components with different expansion or compression techniques being utilised for the different types of signal. The choice of technique is optimised for the specific type of signal.

The expansion of the signal is effected by the splitting of the signal into portions and the insertion of noise between the portions. Desirably, the noise is synthetically generated noise rather than generated from the existing samples, which allows for the insertion of a noise sequence having similar spectral and energy properties to that of the signal components.

DETAILED DESCRIPTION OF THE DRAWINGS

Figure 4:
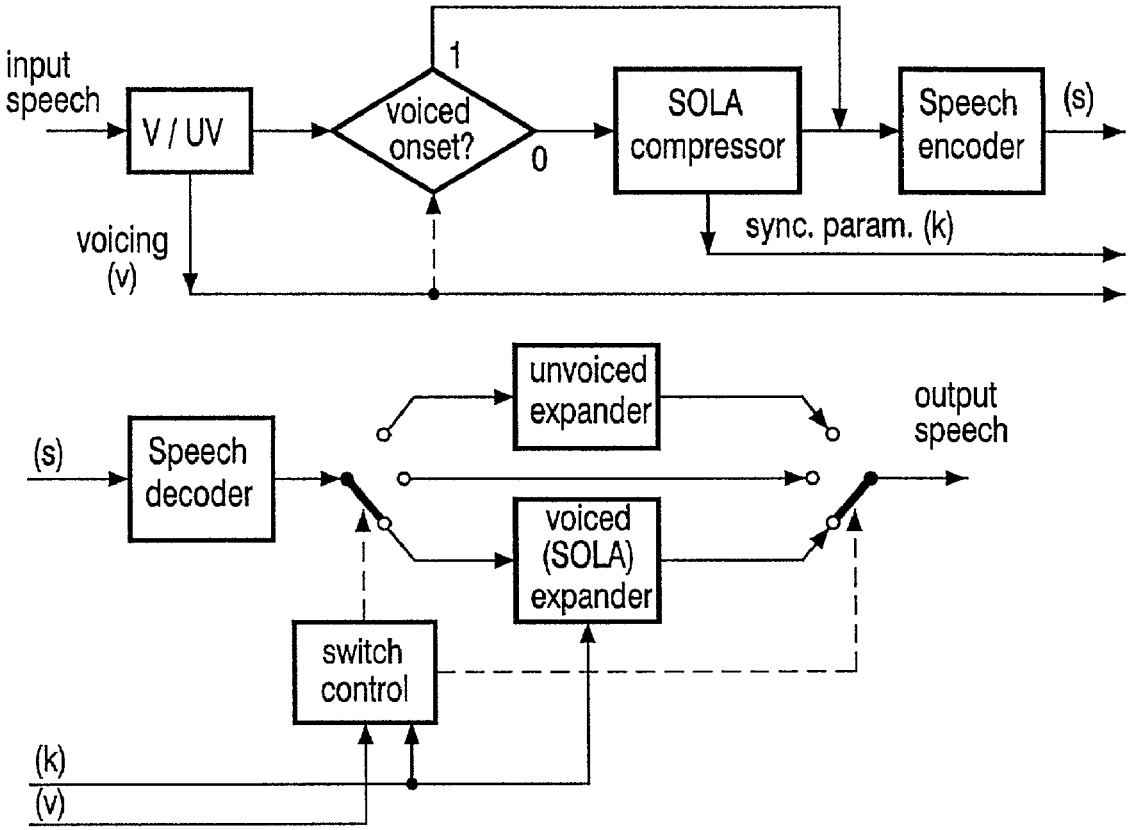
FIG. 4 is a schematic of TSM-based speech coding system according to an embodiment of the present invention.

A first aspect of the present invention provides a method for time-scale modification of signals and is particularly suited for audio signals and is particular to the expansion of unvoiced speech, and is designed to overcome the problem of artificial tonality introduced by the "repetition" mechanism which is inherently present in all time-domain methods. The invention provides for the lengthening of the time-scale by inserting an appropriate amount of synthetic noise that reflects the spectral and energy properties of the input sequence. The estimation of these properties is based on LPC (Linear Predictive Coding) and variance matching. In a preferred embodiment the model parameters are derived from the input signal, which may be an already compressed signal, thereby avoiding the necessity for their transmission. Although it is not intended to limit the invention to any one theoretical analysis, it is thought that only a limited distortion of the above mentioned properties of an unvoiced sequence is caused by a compression of its time-scale. FIG. 4 shows a schematic overview of the system of the present invention. The upper part shows the processing stages at the encoder side. A speech classifier, represented by the block "V/UV", is included to determine unvoiced and voiced speech (frames). All speech is compressed using SOLA, except for the voiced onsets, which are translated. By the term translated, as used within the present specification, it is meant that these frame components are excluded from TSM . Synchronisation parameters and voicing decisions are transmitted through a side channel. As shown in the lower part, they are utilised to identify the decoded speech (frames) and choose the appropriate expansion method. It will be appreciated, therefore, that the present invention provides for the application of different algorithms to different signal types, for example in one preferred application voiced speech is expanded by SOLA, while unvoiced speech is expanded using the parametric method.

Parametric Modelling of Unvoiced Speech

Linear predictive coding is a widely applied method for speech processing, employing the principle of predicting the current sample from a linear combination of previous samples. It is described by Equation 3.1, or, equivalently, by its z-transformed counterpart 3.2. In Equation 3.1, s and $\hat{s}$ respectively denote an original signal and its LPC estimate, and e the prediction error. Further, M determines the order of prediction, and $a_i$ are the LPC coefficients. These coefficients are derived by some of the well-known algorithms ([6], 5.3), which are usually based on least squares error (LSE) minimisation, i.e. minimisation of $\Sigma_n e^2[n]$ $$s[n] = \hat{s}[n] + e[n] = \sum_{i=1}^{M} a[i]s[n-1] + e[n] \quad \text{(equation 3.1)}$$

$$H(z) = \frac{S(z)}{E(z)} = \frac{1}{1 - \sum_{i=1}^{M} a[i] \cdot z^{-1}} = \frac{1}{A(z)} \quad \text{(equation 3.2)}$$

Using the LPC coefficients, a sequence s can be approximated by the synthesis procedure described by Equation 3.2. Explicitly, the filter H(z) (often denoted as 1/A(z)) is excited by a proper signal e, which, ideally, reflects the nature of the prediction error. In the case of unvoiced speech, a suitable excitation is normally distributed zero-mean noise.

Eventually, to ensure a proper amplitude level variation of the synthetic sequence, the excitation noise is multiplied by a suitable gain G. Such a gain is conveniently computed based on variance matching with the original sequence s, as described by Equations 3.3. Usually, the mean value $\bar{s}$ of an unvoiced sound s can be assumed to be equal to 0. But, this need not be the case for its arbitrary segment, especially if s had been submitted to some time-domain weighted averaging (for the purpose of time-scale modification) first.

$$G = \sqrt{\frac{\sigma_s^2}{\sigma_e^2}} \equiv \frac{\sqrt{\frac{1}{N} \cdot \sum_{n=0}^{N-1} (s[n]s)^2}}{\sqrt{\frac{1}{N} \cdot \sum_{n=0}^{N-1} (e[n]e)^2}} \left( \bar{s} = \frac{1}{N} \cdot \sum_{n=0}^{N-1} s[n],\ \bar{e} = 0 \right) \quad \text{(equation 3.3)}$$

Figure 5:
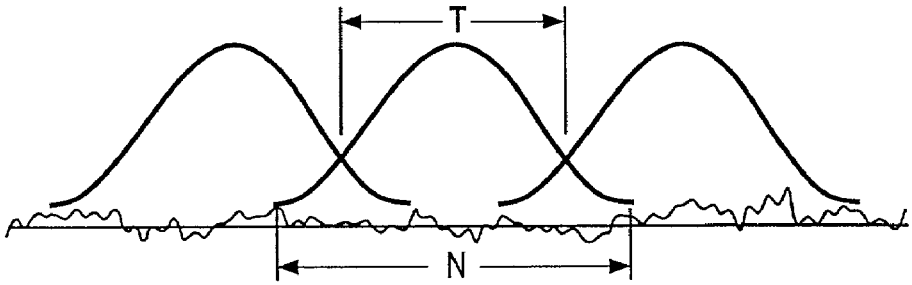
FIG. 5 is a graph showing the segmentation and windowing of unvoiced speech for LPC computation

The described way of signal estimation is only accurate for stationary signals. Therefore, it should only be applied to speech frames, which are quasi-stationary. When LPC computation is concerned, speech segmentation also includes windowing, which has the purpose of minimising smearing in the frequency domain. This is illustrated in FIG. 5, featuring a Hamming window, where N denotes the frame length (typically 15-20 ms), and T the analysis period.

Finally, it should be noted that the gain and LPC computation need not necessarily be performed at the same rate, as the time and frequency resolution that is needed for an accurate estimation of the model parameters does not have to be the same. Typically, the LPC parameters are updated every 10 ms, whereas the gain is updated much faster (e.g. 2.5 ms). Time resolution (described by the gains) for unvoiced speech is perceptually more important than frequency resolution, since unvoiced speech typically has more higher frequencies than voiced speech.

Figure 6:
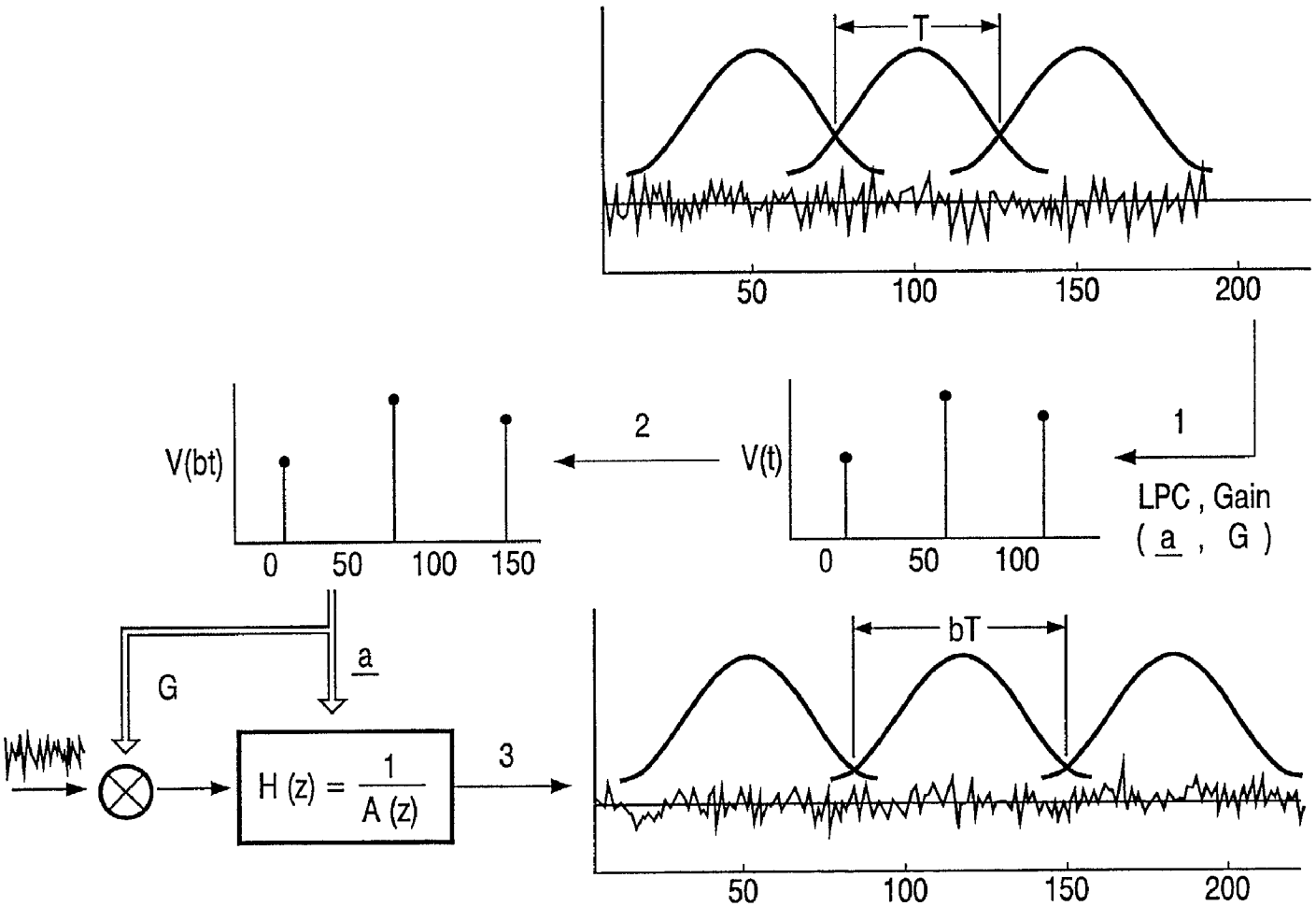
FIG. 6 shows a parametric time-scale expansion of unvoiced speech by factor b>1.
Figure 7A:
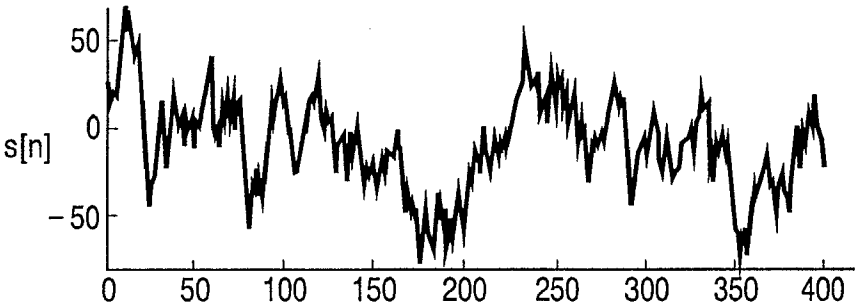
FIG. 7 is an example of time scale companded unvoiced speech, where the noise insertion method of the present invention has been used for the purpose of time scale expansion, and TDHS for the purpose of time scale compression.
Figure 7B:
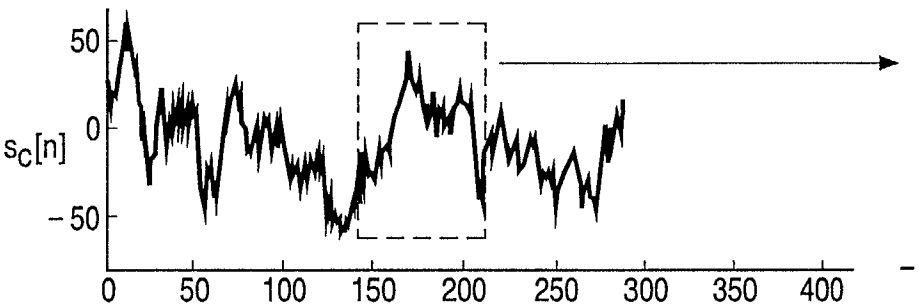
Figure 7C:
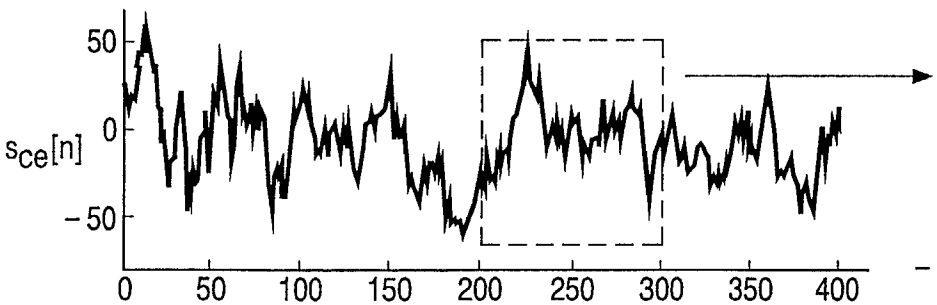
Figure 7D:
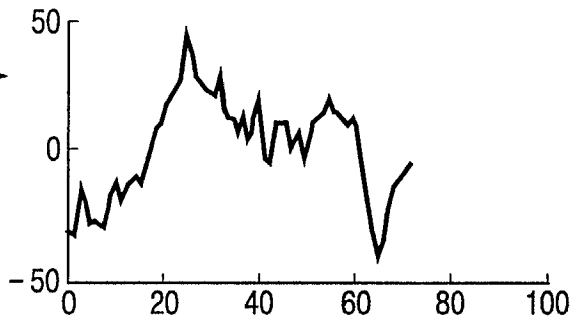
Figure 7E:
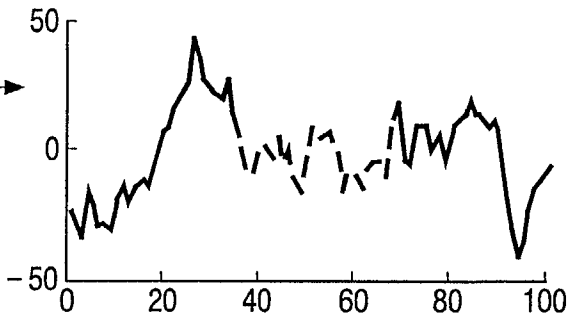

A possible way to realise time-scale modification of unvoiced speech utilising the previously discussed parametric modelling is to perform the synthesis at a different rate than the analysis, and in FIG. 6, a time-scale expansion technique that exploits this idea is illustrated. The model parameters are derived at a rate 1/T (1), and used for the synthesis (3) at rate 1/bT. The Hamming windows deployed during the synthesis are only used to illustrate the rate change. In practice, power complementary weighting would be most appropriate. During the analysis stage, the LPC coefficients and the gain are derived from the input at signal, here at a same rate. Specifically, after each period of T samples, a vector of LPC coefficients a and a gain G are computed over the length of N samples, i.e. for an N-samples long frame. In a way, this can be viewed as defining a 'temporal vector space' V, according to Equation 3.4, which is for simplicity shown as a two-dimensional signal.

$$V = V(a(t), G(t))\ (a = [a_1, \ldots, a_M],\ t = nT,\ n = 1, 2, \ldots) \quad \text{(equation 3.4)}$$

To obtain time-scale expansion by a scale factor b (b>1), this vector space is simply 'down-sampled' by the same factor, prior to the synthesis. Explicitly, after each period of bT samples, an element of V is used for the synthesis of a new N samples-long frame. Hence, compared to the analysis frames, the synthesis frames will be overlapping in time by a smaller amount. To demonstrate this, the frames have been marked by using the Hamming windows again. In practice, it will be appreciated that the overlapping parts of the synthesis frames may be averaged by applying the power-complementary weighting instead, deploying the appropriate windows for that purpose. It will be appreciated that by performing the synthesis at a faster rate than the analysis that time-scale compression could be achieved in a similar way.

It will be appreciated by those skilled in the art that the output signal produced by applying this approach is an entirely synthetic signal. As a possible remedy to reduce the artefacts, which are usually perceived as an increased noisiness, a faster update of the gain could serve. A more effective approach, however, is to reduce the amount of synthetic noise in the output signal. In the case of time-scale expansion, this can be accomplished as detailed below.

Instead of synthesising whole frames at a certain rate, in one embodiment of the present invention a method is provided for the addition of an appropriate and smaller amount of noise to be used to lengthen the input frames. The additional noise for each frame is obtained similar as before, namely from the models (LPC coefficients and the gain) derived for that frame. When expanding compressed sequences, in particular, the window length for LPC computation may generally extend beyond the frame length. This is principally meant to give the region of interest a sufficient weight. Subsequently, a compressed sequence which is being analysed is assumed to have sufficiently retained the spectral and energy properties of the original sequence from which it has been obtained.

Figure 1:
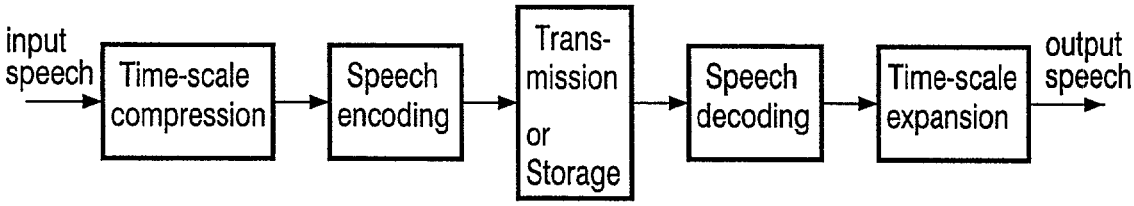
FIG. 1 is a schematic showing the known use of TSM in coding applications.
Figure 2:
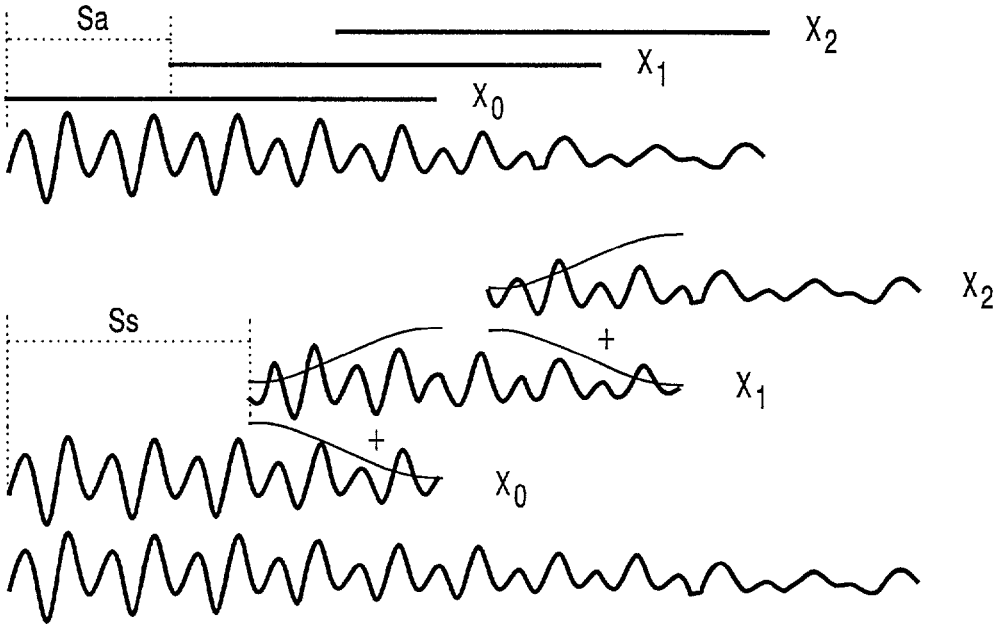
FIG. 2 shows time scale expansion by overlap according to a prior art implementation.
Figure 3:
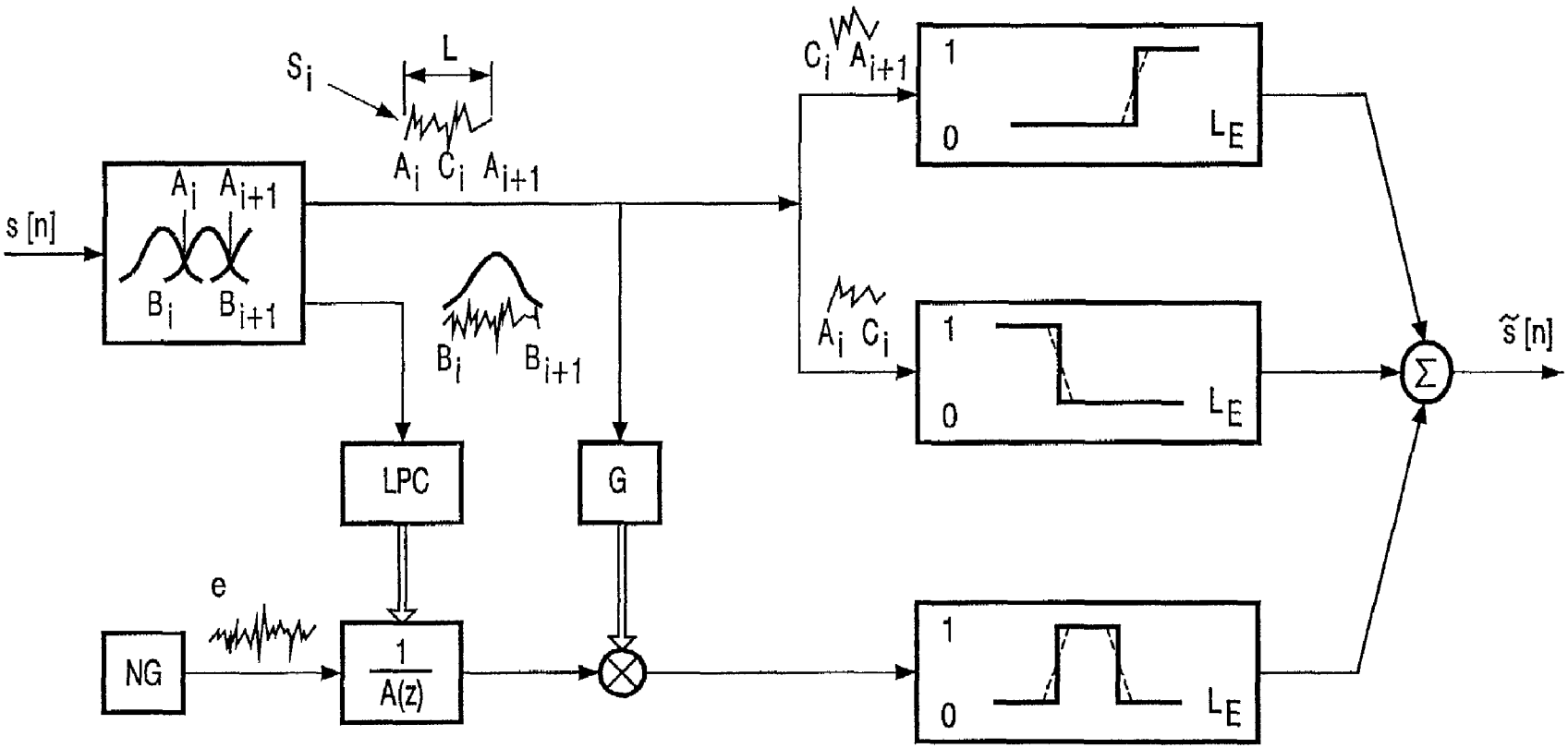
FIG. 3 is a schematic showing time scale expansion of unvoiced speech by adding appropriately modelled synthetic noise according to a first embodiment of the present invention.

Using the illustration from FIG. 3, firstly, an input unvoiced sequence s[n] is submitted to segmentation into frames. Each of the L-samples long input frames $\overline{A_iA_{i+1}}$ will be expanded to a desired length of $L_E$ samples ($L_E = \alpha \cdot L$, where $\alpha > 1$ is the scale factor). In accordance with the earlier explanation, the LPC analysis will be performed on the corresponding, longer frames $\overline{B_iB_{i+1}}$, which, for that purpose, are windowed.

The time-scale expanded version of one particular frame $\overline{A_iA_{i+1}}$ (denoted by $s_i$) is then obtained as follows. A $L_E$ samples long, zero-mean and normally distributed ($\sigma_e = 1$) noise sequence is shaped by the filter 1/A(z), defined by the LPC coefficients derived from $\overline{B_iB_{i+1}}$. Such shaped noise sequence is then given gain and mean values which are equal to those of frame $\overline{A_iA_{i+1}}$. Computation of these parameters is represented by block "G". Next, frame $\overline{A_iA_{i+1}}$ is split into two halves, namely $\overline{A_iC_i}$ and $\overline{C_iA_{i+1}}$, and the additional noise is inserted in between them. This added noise is excised from the middle of the previously synthesised noise sequence of length $L_E$. Practically, it will be appreciated that these actions can be achieved by proper windowing and zero-padding, giving each sequence the same length of $L_E$ samples, then simply adding them all together.

In addition, the windows drawn by dashed lines suggest that averaging (cross-fade) can be performed around the joints of the region where the noise is being inserted. Still, due to the noise-like character of all involved signals, possible (perceptual) benefits of such 'smoothing' in the transition regions remain bounded.

In FIG. 7, the approach explained above is demonstrated by an example. First, TDHS compression has been applied to an original unvoiced sequence s[n], producing $s_c[n]$ as result. The original time-scale has then been re-instated by applying expansion to $s_c[n]$. The noise insertion is made apparent by zooming in on two particular frames.

It will be understood that the above described way of noise insertion is in accordance with the usual way of performing LPC analysis, employing the Hamming window, and since the central part of the frame is given the highest weight, inserting the noise in the middle seems logical. However, if the input frame marks a region close to an acoustical event, like a voicing transition, then inserting the noise in a different way may be more desirable. For example, if the frame consists of unvoiced speech gradually transforming into a more 'voiced-like' speech, then insertion of synthetic noise closer to the beginning of the frame (where the most noise-like speech is located) would be most appropriate. An asymmetrical window putting the most weight on the left part of the frame could then be suitably used for the purpose of LPC analysis. It will be appreciated therefore that the insertion of noise in different regions of the frame may be considered for different types of signal.

Figure 8:
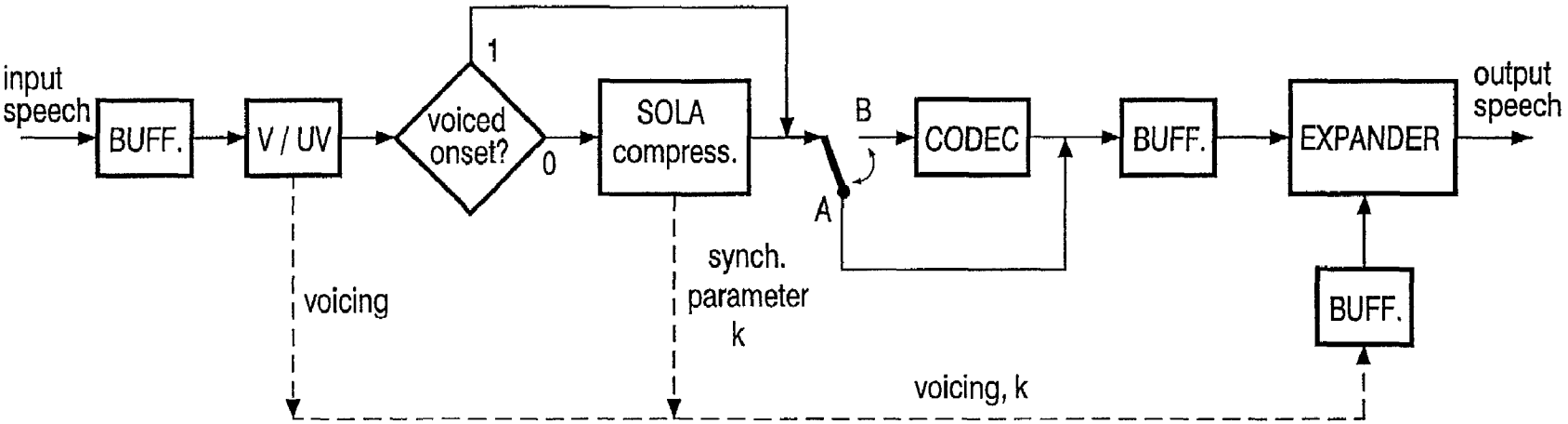
FIG. 8 is a schematic of a speech coding system incorporating TSM according to the present invention.

FIG. 8 shows a TSM-based coding system incorporating all the previously explained concepts. The system comprises of a (tuneable) compressor and a corresponding expander allowing an arbitrary speech codec to be placed in between them. The time-scale companding is desirably realised combining SOLA, parametric expansion of unvoiced speech and the additional concept of translating voiced onsets. It will also be appreciated that the speech coding system of the present invention can also be used independantly for the parametric expansion of unvoiced speech. In the following sections, details concerning the system set-up and realisation of its TSM stages are given, including a comparison with some standard speech coders.

The signal flow can be described as follows. The incoming speech is submitted to buffering and segmentation into frames, to suit the succeeding processing stages. Namely, by performing a voicing analysis on the buffered speech (inside the block denoted by 'V/UV') and shifting the consecutive frames inside the buffer, a flow of the voicing information is created, which is exploited to classify speech parts and handle them accordingly. Specifically, voiced onsets are translated, while all other speech is compressed using SOLA. The outcoming frames are then passed to the codec (A), or bypass the codec (B) directly to the expander. Simultaneously, the synchronisation parameters are transmitted through a side channel. They are used to select and perform a certain expansion method. That is, voiced speech is expanded using SOLA frame shifts $k_i$. During SOLA, the N-samples long analysis frames $x_i$ are excised from an input signal at times i $S_a$, and output at the corresponding times $k_i+iS_s$. Eventually, such modified time-scale can be restored by the opposite process, i.e. by excising N samples long frames $\hat{x}_i$ from the time-scale modified signal at times $k_i+S_s$, and outputting them at times i $S_a$. This procedure can be expressed through Equation 4.0 where $\tilde{s}$ and $\hat{s}$ respectively de-note the TSM-ed and reconstructed version of an original signal s. It is assumed here that $k_0=0$, in accordance with the indexing of k, starting from m=1. $\hat{x}_i$ [n] may be assigned multiple values, i.e. samples from different frames which will overlap in time, and should be averaged by cross-fade.

$$\hat{x}_i[n]=\hat{s}[n+iS_a]=\tilde{s}[n+iS_s+k_i](i=\overline{0,m})\ (n=\overline{0,N-1}) \qquad \text{Equation 4.0}$$

By comparing the consecutive overlap-add stages of SOLA and the reconstruction procedure outlined above, it can easily be seen that $\hat{s}_i$ and $x_i$ will generally not be identical. It will therefore be appreciated that these two processes do not exactly form a "1-1" transformation pair. However, the quality of such reconstruction is notably higher compared to merely applying SOLA that uses a reciprocal $S_s=S_a$ ratio.

The unvoiced speech is desirably expanded using the parametric method previously described. It should be noted that the translated speech segments are used to a realise the expansion, instead of simply being copied to the output. Through suitable buffering and manipulation of all received data, a synchronised processing results, where each incoming frame of the original speech will produce a frame at the output (after an initial delay).

It will be appreciated that a voiced onset may be simply detected as any transition from unvoiced-like to voiced-like speech.

Finally, it should be noted that the voicing analysis could in principle be performed on the compressed speech, as well, and that process could therefore be used to eliminate the need for transmitting the voicing information. However, such speech would be rather inadequate for that purpose, because relatively long analysis frames must usually be analysed in order to obtain reliable voicing decisions.

Figure 9:
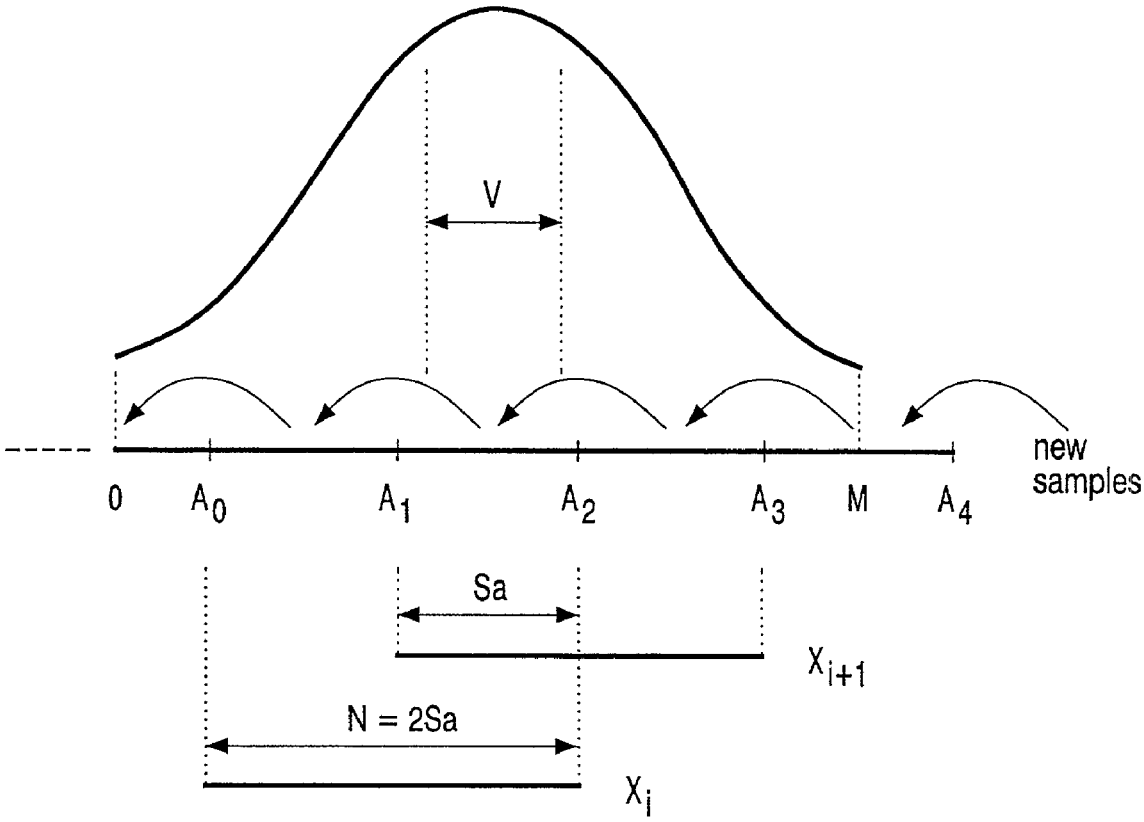
FIG. 9 is a graph showing how the buffer holding the input speech is updated by left-shifting of the $S_a$ samples long frames.

FIG. 9 shows the management of a input speech buffer, according to the present invention. The speech contained in the buffer at a certain time is represented by segment $\overline{0A_4}$. The segment $\overline{0M}$, underlying the Hamming window, is submitted to voicing analysis, providing a voicing decision which is associated to V samples in the centre. The window is only used for illustration, and does not suggest the necessity for weighting of the speech, an example of the techniques which may be used for any weighting may be found in R. J. McAulay and T. F. Quatieri, "Pitch estimation and voicing detection based on a sinusoidal speech model", IEEE Int. Conf. on Acoustics Speech and Signal Processing, 1990. The acquired voicing decision is attributed to $S_a$ samples long segment $\overline{A_1A_2}$, where $V \leqq S_a$ and $|S_a-V| << S_a$. Further, the speech is segmented in Sa samples long frames $\overline{A_iA_{i+1}}$ (i=0, . . . , 3), enabling a convenient realisation of SOLA and buffer management. Specifically, $\overline{A_0A_2}$ and $\overline{A_1A_3}$ will play the role of two consecutive SOLA analysis frames $x_i$, and $x_i+1$, while the buffer will be updated by left-shifting of frames $\overline{A_iA_{i+1}}$ (i=0, 1, 2) and putting new samples at the 'emptied' position of $\overline{A_3A_4}$.

Figure 10:
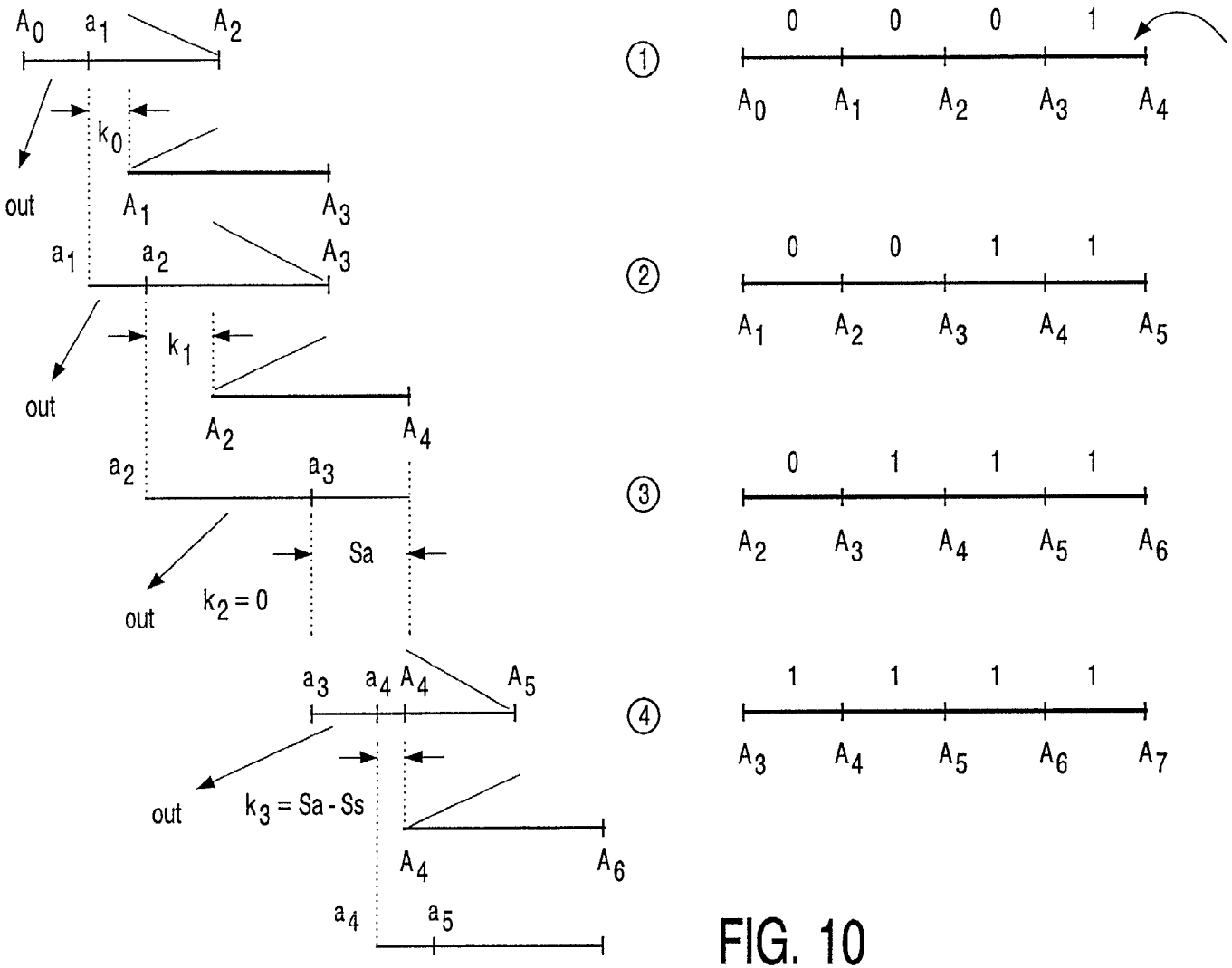
FIG. 10 shows the flow of the input (-right) and output (-left) speech in the compressor.
Figure 11:
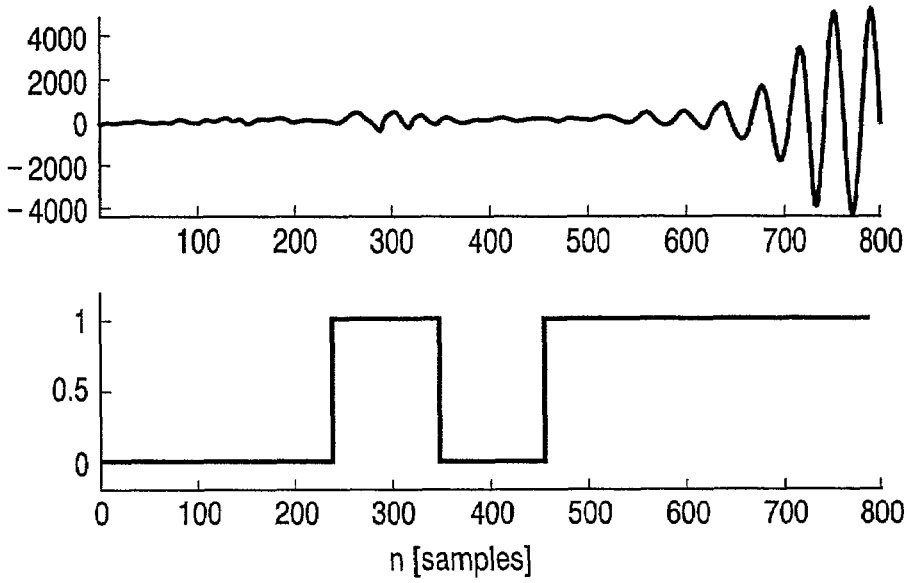
FIG. 11 shows a speech signal and the corresponding voicing contour (voiced=1)

The compression can easily be described using FIG. 10, where four initial iterations are illustrated. The flow of the input and output speech can be respectively followed on the right and left side of the figure, where some familiar features of SOLA are apparent. Among the input frames, voiced ones are marked by "1" and unvoiced by "0".

Initially, the buffer contains a zero signal. Then, a first frame $d(\overline{A_3A_4})$ is read, in this case announcing a voiced segment. Note that the voicing of this frame will be known only after it has arrived at the position of $\overline{A_1A_2}$, in accordance with the earlier described way of performing the voicing analysis. Thus, the algorithmical delay amounts $3S_a$ samples. On the left side, the continuously changing gray-painted frame, hence synthesis frame, represent the front samples of the buffer holding the output (synthesis) speech at a particular time. (As will become clear, the minimal length of this buffer is $(k_i)\max+2S_a=3S_a$ samples.) In accordance with SOLA, this frame is updated by overlap add with the consecutive analysis frames, at the rate determined by $S_s$ ($S_s<S_a$). So, after first two iterations, the $S_s$, samples long frames $\overline{A_0a_1}$ and $\overline{a_1a_2}$ will consecutively have been output, as they become obsolete for new updates, respectively by the analysis frames $\overline{A_1A_3}$ and $\overline{A_2A_4}$. This SOLA compression will continue as long as the present voicing decision has not changed from 0 to 1, which here happens in step 3. At that point, the whole synthesis frame will be output, except for its last Sa samples, to which last Sa samples from the current analysis frame are appended. This can be viewed as re-initialisation of the synthesis frame, now becoming $\overline{a_3A_5}$. With it, a new SOLA compression cycle starts in step 4, etc.

It can be seen that, while maintaining speech continuity, much of frame $\overline{a_3A_4}$ will be translated, as well as several input frames succeeding it, thanks to SOLA's slow convergence. These parts exactly correspond to the region which is most likely to contain a voiced onset.

It can now be concluded that after each iteration the compressor will output an "information triplet", consisting of a speech frame, SOLA k and a voicing decision corresponding to the front frame in the buffer. Since no cross-correlation is computed during the translation, $k_i=0$ will be attributed to each translated frame. So, by denoting speech frames by their length, the triplets produced in this case are ($S_s$, $k_0$, 0), ($S_s$, $k_1$, 0), ($S_a+k_1$, 0, 0) and ($S_s$, $k_3$, 1). Note that the transmission of (most) k's acquired during the compression of unvoiced speech is superfluous, because (most) unvoiced frames will be expanded using the parametric method.

The expander is desirably adapted to keep the track of the synchronisation parameters in order to identify the incoming frames and handle them appropriately.

The principal consequence of translation of voiced onsets is that it "disturbs" a continuous time-scale compression. It will be appreciated that all compressed frames have the equal length of $S_s$ samples, while the length of translated frames is variable. This could introduce difficulties in maintaining a constant bit-rate when the time-scale compression is followed by the coding. At this stage, we choose to compromise the requirement of achieving a constant bit rate, in favour of achieving a better quality.

With respect to the quality, one could also argue that preserving a segment of the speech through translation could introduce discontinuities if the connecting segments on its both sides are distorted. By detecting voiced onsets early, which implies that the translated segment will start with a part of the unvoiced speech preceding the onset it is possible to minimise the effect of such discontinuities. It will be appreciated also that SOLA's slow convergence for moderate compression rates, which ensures that the terminating part of the translated speech will include some of the voiced speech succeeding the onset.

It will be appreciated that during the compression each incoming $S_a$ samples long frame will produce an $S_s$ or $S_a+k_{i-1}$ ($ki\leqq S_a$) samples long frame at the output. Hence, in order to reinstate the original time-scale, the speech coming from the expander should desirably comprise of $S_a$ samples long frames, or frames having different lengths but producing the same total length of $m\cdot S_a$, with m being the number of iterations. The present discussion is with regard to a realisation which is capable of only approximating the desired length and is the result of a pragmatic choice, allowing us to simplify the operations and avoid introducing further algorithmical delay. It will be appreciated that alternative methodology may be deemed necessary for differing applications.

In the following, we shall assume to have disposal over several separate buffers, all of which will be updated by simple shifting of samples. For the sake of illustration, we shall be showing the complete "information triplets" as produced by the compressor, including the k's acquired during compression of unvoiced sounds, most of which are actually obsolete.

Figure 12:
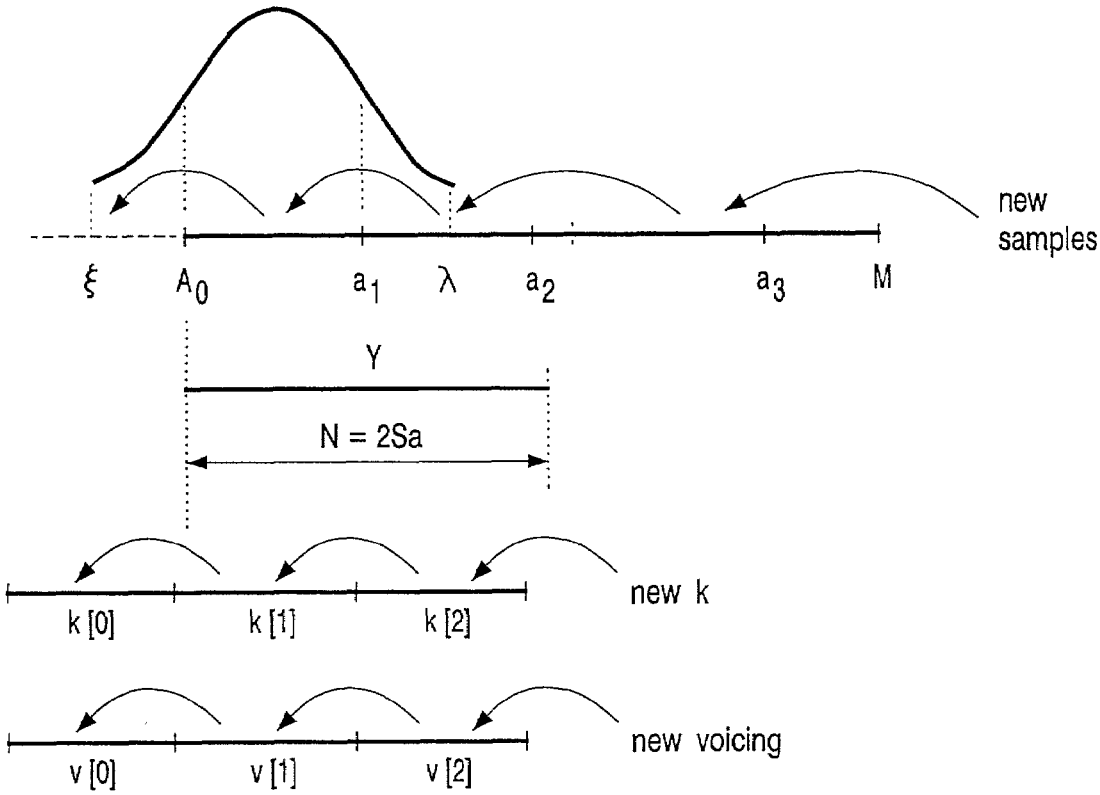
FIG. 12 is an illustration of different buffers during the initial stage of expansion, which follows directly the compression illustrated in FIG. 10

This is also illustrated in FIG. 12, where an initial state is shown. The buffer for incoming speech is represented by segment $\overline{A_0M}$, which is $4S_a$ samples long. For the sake of illustration, it is assumed the expansion directly follows the compression described in FIG. 10. Two additional buffers $\overline{\xi\lambda}$ and Y will serve, respectively, to provide the input information for the LPC analysis and to facilitate expansion of voiced parts. Another two buffers are deployed to hold the synchronisation parameters, namely the voicing decisions and k's. The flow of these parameters will be used as a criterion to identify the incoming speech frames and handle them appropriately. From now on, we shall refer to positions 0, 1 and 2 as past, present and future, respectively.

During the expansion, some typical actions will be performed on the "present" frame, invoked by particular states of the buffers containing the synchronisation parameters. In the following, this is clarified through examples.

i. Unvoiced Expansion

Figure 13:
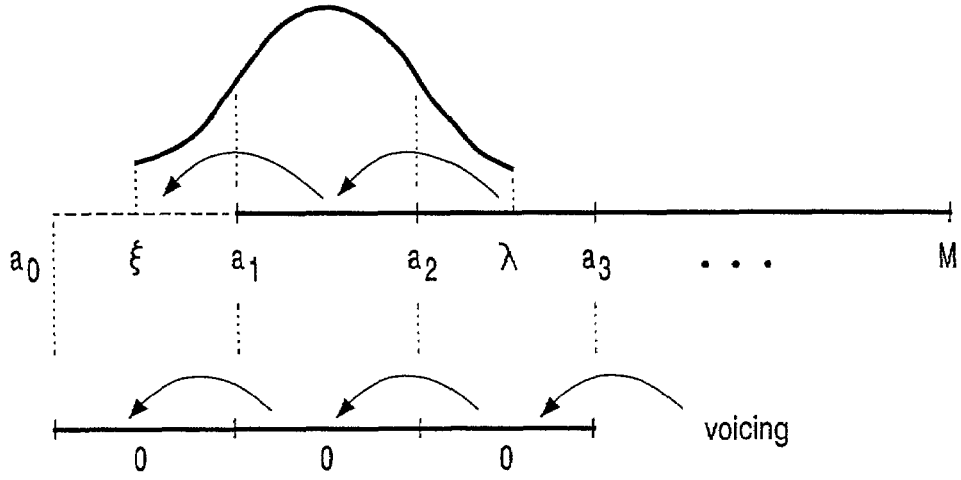
FIG. 13 shows the example where a present unvoiced frame is expanded using the parametric method only if both past and future frames are unvoiced as well.

The parametric expansion method previously described is exclusively deployed in the situation where all three frames of interest are unvoiced, as shown in FIG. 13. This implies, $d(\overline{A_0a_4})=S_s$, $d(\overline{a_1a_2})=S_s$ and $d(\overline{a_2a_3})=S_a$ or $S_a+k[1]$. Later, an additional requirement will also be introduced and explained, stating that these frames should not form an immediate continuation of a voiced offset (transition from voiced to unvoiced speech).

Hence, the present frame $\overline{a_1a_2}$ is extended to the length of $S_a$ samples and output, which is followed by left shifting the buffer contents by $S_s$ samples, making $\overline{a_2a_3}$ new present frame and updating the contents of the "LPC buffer" $\overline{\xi\lambda}$. (Typically, $d(\overline{\xi\lambda})\approx 2S_s$).

ii. Voiced Expansion

Figure 14:
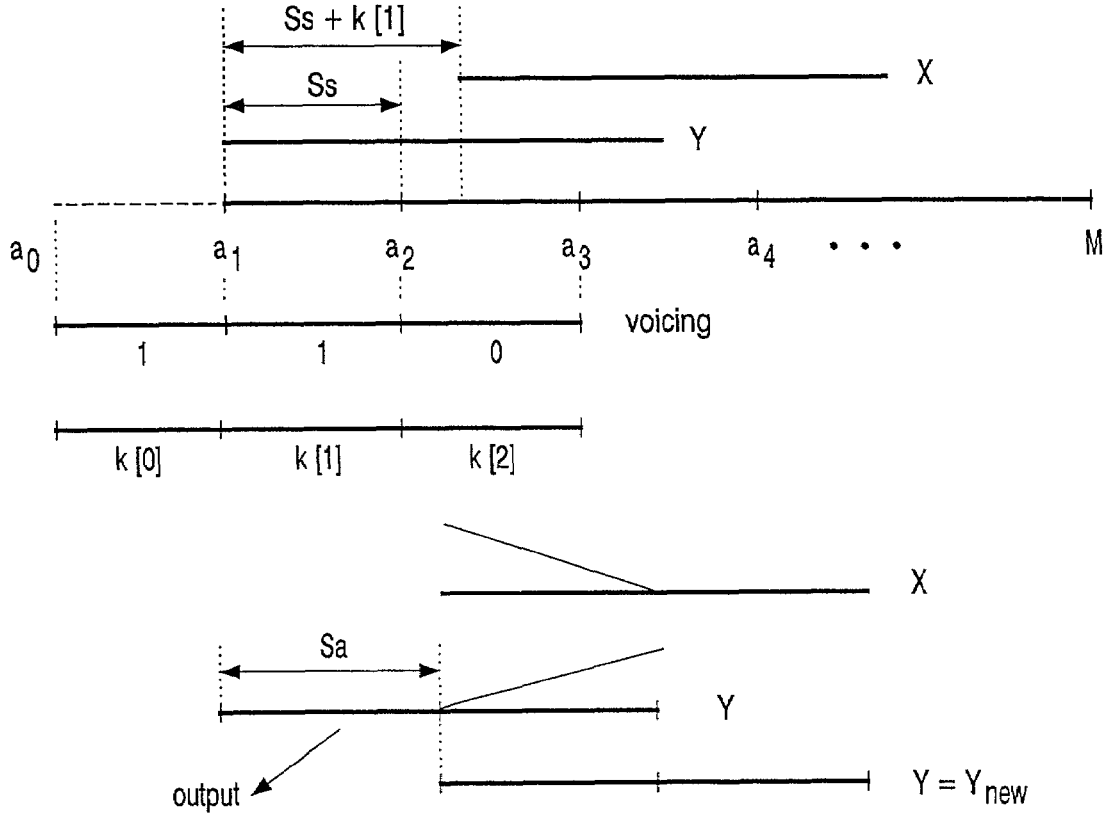
FIG. 14 shows how during voiced expansion, the present $S_s$ samples long frame is expanded by outputting front $S_a$ samples from 2 $S_a$ samples long buffer Y.

A possible voicing state invoking this expansion method is illustrated in FIG. 14. Let us first assume that the compressed signal starts with $\overline{a_1a_2}$ i.e. that $\overline{a_0a_1}$, v[0] and k[0] are empty. Then, Y and X exactly represent the first two frames of a time-scale "reconstruction" process. In this "reconstruction" process, $2S_a$ samples long frames $\hat{x}_i$ with in this case $Y=\hat{x}_0$, $X=\hat{x}_i$, need to be excised from the compressed signal at position $iS_s+k_i$ and "put back" at the original positions $iS_a$, while cross-fading the overlapping samples. The first $S_a$ samples of Y are not used during the overlapped, so they are output. This can be viewed as expansion of $S_s$ samples long frame $\overline{a_1a_2}$, which is then replaced by its successor $\overline{a_2a_3}$ by the usual left-shifting. It is now clear that all consecutive $S_s$ samples long frames can be expanded in the analogue way, i.e. by outputting first $S_a$ samples from buffer Y. where the rest of this buffer is continuously up-dated through overlap-add with X obtained for a certain present k, i.e. k[1]. Explicitly, X will contain $2S_a$ samples from the input buffer, starting with $S_s$+k[1]-th sample.

iii. Translation

As detailed previously the term "translation" as used within the present specification is intended to refer to all situations where the present frame, or a part of it, is output as is or skipped, i.e. shifted but not output. FIG. 14 shows that at the time the unvoiced frame $\overline{a_2a_3}$ has become the present frame, its front $S_a$-$S_s$ samples will already have been output during the previous iteration. Namely, these samples are included in the front $S_a$ samples of Y. which have been output during the expansion of $\overline{a_2a_3}$. Consequently, expanding a present unvoiced frame that follows a past voiced frame using the parametric method would disturb speech continuity. Therefore, we first decide to maintain voiced expansion during such voiced offsets. In other words, the voiced expansion is prolonged to the first unvoiced frame succeeding a voiced frame. This will not activate the "tonality problem", which is primarily caused when "repetition" of SOLA expansion extends over a relatively longer unvoiced segment.

However, it is clear that the above outlined problem will now only be postponed and will re-appear with the future frame $\overline{a_3a_4}$. Keeping in mind the way voicing expansion is performed, i.e. the way Y is updated, a total of $k_i(0<k<S_a)$ samples may have already been output (modified by cross-fade) before they have arrived at the front of the buffer.

In order to obviate this problem firstly, each present $k_i$ samples that have been used in the past is skipped. This now implies a deviation from the principle exploited so far, where for each incoming $S_s$ samples $S_a$ samples are output. In order to compensate "the shortage" of samples", we shall use the "surplus" of samples contained in the translated $S_a$ +kj samples long frames produced by the compressor, If such a frame does not directly follow a voiced offset (if a voiced onset does not appear shortly after a voiced offset) then none of its samples will have been used in the previous iterations, and it can be output as a whole. Hence, the "shortage" of $k_i$ samples following a voiced offset will be counterbalanced by a "surplus" of at most $k_j$ samples proceeding the next voiced onset.

Since both $k_j$ and $k_i$ are obtained during compression of unvoiced speech, therefore having a random-like character, their counterbalance will not be exact for a particular j and i. As a consequence, a slight mismatch between the duration of the original and the corresponding companded unvoiced sounds will generally result, which is expected to be not perceivable. At the same time, speech continuity is assured.

It should be noted that the mismatch problem could easily be tackled even without introducing additional delay and processing, by choosing the same k for all unvoiced frames during the compression. Possible quality degradation due to this action is expected to remain bounded, since waveform similarity, based on which k is computed, is not an essential similarity measure for unvoiced speech.

It should be noted that it is desirable for all the buffers to be consistently updated, in order to ensure speech continuity when switching between different actions. For the purpose of this switching and identification of incoming frames, a decision mechanism has been established, based on inspecting the states of voicing and "k-buffer". It can be summarised through the table given below, where the previously described actions are abbreviated. To signal "re-usage" of samples, i.e. occurrence of a voiced offset in the past, an additional predicate named "offset" is introduced. It can be defined by looking one step further into the past of the voicing buffer, as true if v[0]=1 v v[−1]=1 and false in all other cases (v denotes logical "or"). Note that through suitable manipulation, no explicit memory location for v[−1] is needed.

TABLE 1

Selecting actions of the expander

| v[0] | v[1] | v[2] | offset | k[0] > $S_S$ | ACTION |
|---|---|---|---|---|---|
| 0 | 0 | 0 | 0 | — | UV |
| 0 | 0 | 0 | 1 | 0 | UV |
| 0 | 0 | 0 | 1 | 1 | T |
| 0 | 0 | 1 | — | — | T |
| 0 | 1 | 1 | — | — | V |
| 1 | 0 | 0 | — | — | V |
| 1 | 0 | 1 | — | — | T |
| 1 | 1 | 0 | — | — | V |
| 1 | 1 | 1 | — | — | V |

It will be appreciated that the present invention utilises a time-scale expansion method for unvoiced speech. Unvoiced speech is compressed with SOLA, but expanded by insertion of noise with the spectral shape and the gain of its adjacent segments. This avoids the artificial correlation which is introduced by "re-using" unvoiced segments.

If TSM is combined with speech coders that operate at lower bit rates (i.e. <8 kbit/s), the TSM-based coding performs worse compared to conventional coding (in this case AMR). If the speech coder is operating at higher bit rates, a comparable performance can be achieved. This can have several benefits. The bit rate of a speech coder with a fixed bit rate can now be lowered to any arbitrary bit rate by using higher compression ratios. By compression ratios up to 25%, the performance of the TSM system can be comparable to a dedicated speech coder. Since the compression ratio can be varied in time, the bit rate of the TSM system can also be varied in time. For example, in case of network congestion, the bit rate can be temporarily lowered. The bit stream syntax of this speech coder is not changed by the TSM. Therefore, standardised speech coders can be used in a bit stream compatible manner. Furthermore, TSM can be used for error concealment in case of erroneous transmission or storage. If a frame is received erroneously, the adjacent frames can be time-scale expanded more in order to fill the gap introduced by the erroneous frame.

It has been shown that most of the problems accompanying time-scale companding occur during the unvoiced segments and voiced onsets that are present in a speech signal. In the output signal, the unvoiced sounds take on a tonal character, while less gradual and smooth voiced onsets are often smeared, especially when larger scale factors are used. The tonality in unvoiced sounds is introduced by the "repetition" mechanism which is inherently present in all time-domain algorithms. To overcome this problem, the present invention provides separate methods for expanding voiced and unvoiced speech. A method is provided for expansion of unvoiced speech, which is based on inserting an appropriately shaped noise sequence into the compressed unvoiced sequences. To avoid smearing of voiced onsets, the voice onsets are excluded from TSM and are then translated.

The combination of these concepts with SOLA, has enabled the realisation of a time-scale companding system which outperforms the traditional realisations that use a similar algorithm for both compression and expansion.

It will be appreciated that the introduction of a speech codec between the TSM stages may cause quality degradation, being more noticeable in proportion to the lowering of the bit-rate of the codec. When a particular codec and TSM are combined to produce a certain bit-rate, the resulting system performs worse than dedicated speech coders operating at a comparable bit-rate. At lower bit-rates, quality degradation is unacceptable. However, TSM can be beneficial in providing graceful degradation at higher bit-rates.

Although hereinbefore described with reference to one specific implementation it will be appreciated that several modifications are possible. Refinements of the proposed expansion method for unvoiced speech through deploying alternative ways of noise insertion and gain computation could be utilised.

Similarly, although the description of the invention is mainly addressed to time scale expanding a speech signal, the invention is further applicable to other signals such as but not limited to an audio signal.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word 'comprising' does not exclude the presence of other elements or steps than those listed in a claim. The invention can be implemented by means of hardware comprising several distinct elements, and by means of a suitably programmed computer. In a device claim enumerating several means, several of these means can be embodied by one and the same item of hardware. The mere fact that certain measures are recited in mutually different dependent claims does not indicate that a combination of these measures cannot be used to advantage.

REFERENCES

[1] J. Makhoul, A. El-Jaroudi, "Time-Scale Modification in Medium to Low Rate Speech Coding", Proc. of ICASSP, Apr. 7-11, 1986, Vol. 3, p. 1705-1708.

[2] P. E. Papamichalis, "Practical Approaches to Speech Coding", Prentice Hall, Inc., Engelwood Cliffs, N.J., 1987

[3] F. Amano, K. Iseda, K. Okazaki, S. Unagami, "An 8 kbit/s TC-MQ (Timedomain Compression ADPCM-MQ) Speech Codec", Proc. of ICASSP, Apr. 11-14, 1988, Vol. 1, p. 259-262.

[4] S. Roucos, A. Wilgus, "High Quality Time-Scale Modification for Speech", Proc. of ICASSP, Mar. 26-29, 1985, Vol. 2, p. 493-496.

[5] J. L. Wayman, D. L. Wilson, "Some Improvements on the Method of Time-Scale-Modification for Use in Real-Time Speech Compression and Noise Filtering", IEEE Transactions on ASSP, Vol. 36, No. 1, p. 139-140, 1988.

[6]E. Hardam, "High Quality Time-Scale Modification of Speech Signals Using Fast Synchronized-Overlap-Add Algorithms", Proc. of ICASSP, Apr. 34, 1990, Vol. 1, p. 409-412.

[7] M. Sungjoo-Lee, Hee-Dong-Kim, Hyung-Soon-Kim, "Variable Time-Scale Modification of Speech Using Transient Information", Proc. of ICASSP, Apr. 21-24, 1997, p. 1319-1322.

[8] WO 96/27184A

The invention claimed is:

1. A method of time scale modifying a signal, the method comprising the acts of:

defining individual frame segments within the signal, analyzing the individual frame segments to determine a signal type in each frame segment, applying a first algorithm to a determined first signal type and a second different algorithm to a determined second signal type, wherein the first and second algorithms are time scale modification algorithms and the method is used for time scale modification of the signal, and wherein the first signal type is a voiced signal segment and wherein the second signal type is an un-voiced signal segment, splitting the un-voiced speech signal in a first portion and a second portion, and inserting noise in between the first portion and the second portion to obtain a time scale expanded signal, wherein the noise is synthetic noise with a spectral shape equivalent to the spectral shape of the first and second portions of the signal and wherein the inserted noise is excised from the middle of a previously synthesized noise sequence.

2. The method as claimed in claim 1 wherein the first algorithm is based on a waveform technique and the second algorithm is based on a parametric technique.

3. The method as claimed in claim 1 wherein the first algorithm is a SOLA algorithm.

4. The method as claimed in claim 1 wherein the second algorithm comprises the acts of:

dividing each frame of the determined second signal type into a lead in and a lead out portion, generating a noise signal, and inserting the noise signal between the lead-in and lead-out portions so as to effect an expanded segment.

5. The method as claimed in claim 1 wherein the first and second algorithms are expansion algorithms and the method is used for time scale expanding a signal.

6. The method as claimed in claim 1 wherein the first and second algorithms are compression algorithms and the method is used for time scale compressing a signal.

7. A method as claimed in claim 1, wherein the signal is a time scale modified audio signal.

8. A method as claimed in claim 1, wherein the signal is an audio signal and in particular unvoiced segments are time scale expanded.

9. The method of claim 1, further comprising generating the noise from linear predictive coding coefficients and gain derived from the first portion and the second portion.

10. The method of claim 1, further comprising shaping the noise by a filter defined by linear predictive coding coefficients derived from at least one of the first portion and the second portion.

11. A method of receiving an audio signal, the method comprising the acts of:

decoding the audio signal, and time scale expanding the decoded audio signal according to a method as claimed in claim 1.

12. A time scale modifying device adapted to modify a signal so as to effect the formation of a time scale modified signal comprising:

a) means for determining different signal types within frames of the signal, b) means for applying a first time scale modification algorithm to frames having a first determined signal type and a second different time scale modification algorithm to frames having a second determined signal type, wherein the first signal type is a voiced signal segment and wherein the second signal type is an un-voiced signal segment, means for splitting the un-voiced speech signal in a first portion and a second portion, and means for inserting noise in between the first portion and the second portion to obtain a time scale expanded signal, wherein the noise is synthetic noise with a spectral shape equivalent to the spectral shape of the first and second portions of the signal and wherein the inserted noise is excised from the middle of a previously synthesized noise sequence.

13. The device as claimed in claim 12 wherein the means for applying a second different modification algorithm to the second determined signal type comprises:

a) means for splitting the signal frame in a first portion and a second portion, and b) means for inserting noise in between the first portion and the second portion to obtain a time scale expanded signal.

14. A receiver for receiving an audio signal, the receiver comprising:

a) a decoder for decoding the audio signal, and b) a device according to claim 12 for time scale expanding the decoded audio signal.

15. The device of claim 12, further comprising means for generating the noise from linear predictive coding coefficients and gain derived from the first portion and the second portion.

16. The device of claim 12, further comprising a filter configured to shape the noise, wherein the filter is defined by linear predictive coding coefficients derived from at least one of the first portion and the second portion.

* * * * *